United States Patent [19]

Przytulla

[11] Patent Number: 4,768,673

[45] Date of Patent: Sep. 6, 1988

[54] BUNGED VESSEL

[75] Inventor: Dietmar Przytulla, Sindorf, Fed. Rep. of Germany

[73] Assignee: Mauser-Werke GmbH, Bruhl, Fed. Rep. of Germany

[21] Appl. No.: 68,684

[22] Filed: Jul. 1, 1987

[30] Foreign Application Priority Data

Jul. 4, 1986 [DE] Fed. Rep. of Germany ..... 3622575

[51] Int. Cl.[4] ..... B65D 5/16

[52] U.S. Cl. ..... 220/71; 220/73

[58] Field of Search ..... 220/71, 72, 73, 76

[56] References Cited

U.S. PATENT DOCUMENTS

| | | | |
|---|---|---|---|
| 2,686,610 | 8/1954 | Sharpnack, Sr. | 220/71 |
| 3,294,271 | 12/1966 | Armbruster | 220/71 |
| 3,348,721 | 10/1967 | Trevarrow, Jr. | 220/71 |
| 3,501,047 | 3/1970 | Raabe | 220/71 |
| 4,372,458 | 7/1983 | Carlson | 220/71 |
| 4,385,709 | 5/1983 | Ames | 220/71 |
| 4,489,847 | 12/1984 | Ames | 220/71 |

*Primary Examiner*—Joseph Man-Fu Moy

*Attorney, Agent, or Firm*—Pennie & Edmonds

[57] ABSTRACT

A bunged vessel of thermoplastic material having outward projections at the upper edge of separately prefabricated carrying and transport rings for the prongs of an engaging handling means. The head surface of the wall of the vessel projects at a distance beyond the tip edge of the associated carrying and transport ring, and the wall portion extending from the point of attachment of the ring to the associated head surface of the vessel being conically inclined to the vertical centerline of the vessel.

5 Claims, 1 Drawing Sheet

BUNGED VESSEL

BACKGROUND OF THE INVENTION

The invention relates to a bunged vessel of thermoplastic material having at least one separately prefabricated carrying and transport ring snapped onto the vessel wall near the associated head of the vessel, with an outward projection molded onto the upper edge of the ring for the prongs of a handling means.

Plastic vessels thus equipped can be picked up, lifted and transported without manual maneuvers using the conventional fittings of a fork lift truck. Ordinarily, such carrying and transport rings have a cross-section with a horizontal and vertical web. The free end of the vertical web is directed towards the respective head of the vessel, and the horizontal web is molded radially outward.

The handling means of lifting and transporting such vessels engages its prongs firstly under the horizontally outward directed web of the ring and behind the vertically upward directed web. The entire load of the vessel is transmitted by the horizontally outward directed web to the lower prong of the handling means, while the prong engaged behind the vertical web secures the vessel against slipping off.

It is known that the carrying and transport ring may be made in one piece with the wall of the vessel. In so doing, the tube extruded into the opened mold is pinched off and welded by the meeting lateral halves of the main mold. The carrying and transport ring regions of the halves of the main mold each contain a vertically displaceable slide with the ring profiles cut into its inner contours. In the blowing operation, the enlarging tube is forced into the recesses between main mold and slide.

Then the slides are closed and the tube material is formed in the ring mold. Wall layers are thus formed, which are welded together by their own heat. In transport or if a filled vessel is dropped, these welds are exposed to high tensile and bending stresses.

From the foregoing it follows that to produce a vessel of this construction, a considerable mold-making outlay must be expended. To avoid this, there have been attempts to weld separately prefabricated carrying and transport rings onto the wall of the vessel, or to snap them into recesses provided for that purpose in the wall of the vessel as blown. In the latter case, the construction of the mold is much simplified because the slides capable of vertical displacement in the halves of the main mold can be dispensed with.

A disadvantage of bunged vessels with carrying transport rings snapped onto the wall of the vessel is the fact that the extension molded onto the top edge of the ring for the prongs of a handling means generally projects beyond the head surface of the wall of the vessel so that the handling means can be applied. The wall of the vessel is in fact cylindrical in shape, and meets the plane of the head of the vessel nearly at right angles. The projection of the ring is disadvantageous because the entire stack load, if several vessels are stacked one upon another, must be assumed by the carrying and transport ring. The ring is moreover unprotected, so that the full impact energy of a dropped vessel will act on the free extremity of the ring. Furthermore, the protruding length of the carrying and transport ring acts as a lever arm, so that if a dropped vessel lands obliquely, the carrying ring may be pried out of its attachment.

It is therefore an object of the present invention to provide a blown plastic bung vessel with a separate, snap-on carry and transport ring such that the complexity of the vessel mold may be greatly reduced.

It is a further object of the invention to provide the carry and transport ring with a means of attachment and location such that it will not be subject to excessive stresses when the vessel is stacked or dropped, while at the same time providing adequate clearance for the prongs of a mechanical handling means.

SUMMARY OF THE INVENTION

These and other objects are achieved by providing a bung vessel with a snap-on carry and transport ring wherein the head surface of the wall of the vessel projects at a distance beyond the top edge of the carrying and transport ring. The wall region extending from the point of attachment of the ring to the associated head of the vessel is conically inclined to the vertical centerline of the vessel.

In this way, the carrying and transport ring is in a protected location on the wall of the vessel, while the conical inclination of the wall leaves sufficient room to admit the handling means. The stack load is transmitted directly by way of the head or end surface of the vessel into the vessel wall, and if a filled vessel is dropped, the impact energy will be largely absorbed by the portion of wall projecting beyond the carrying and transport ring, because it acts as a crumple zone.

DETAILED DESCRIPTION OF THE INVENTION

Figure 1:
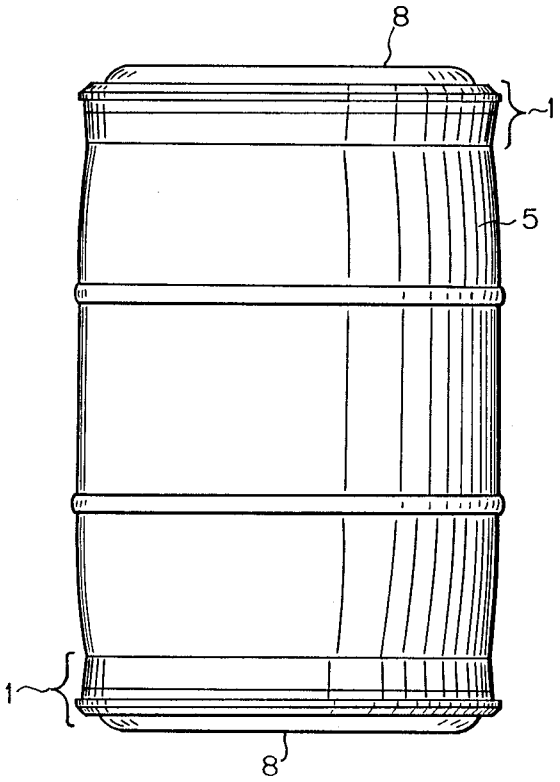
FIG. 1 shows a side view of the bunged vessel of the present invention.

The general location of the carrying and transport ring 1 in relation to the head surface 8 and the vessel wall 5 is shown in FIG. 1.

Figure 2:
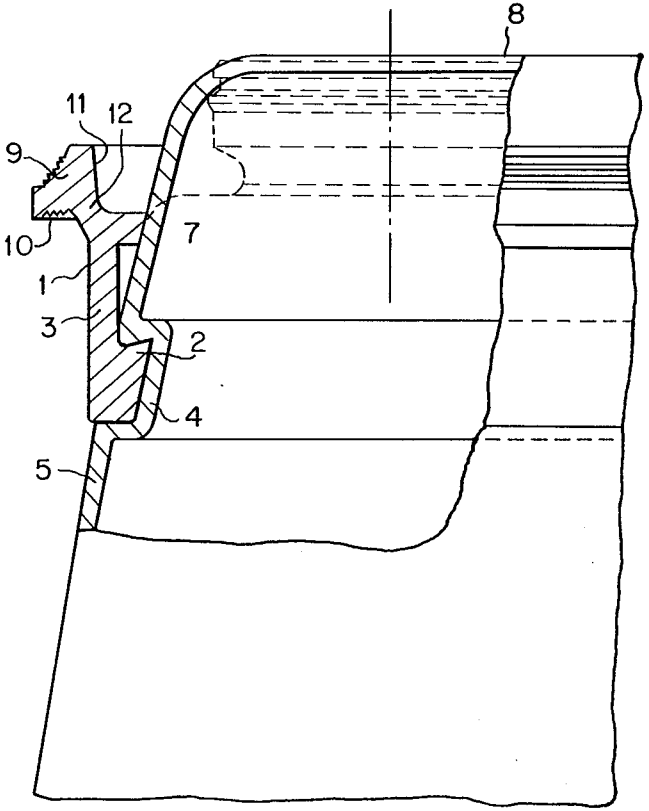
FIG. 2 shows a sectional side view of the upper left portion of the bunged vessel of FIG. 1, the location of the bung is depicted in dotted lines.

A more detailed understanding of the invention may be obtained from FIG. 2. Behind the carrying and transport ring 1, the vessel wall 5 forms a shell ascending conically to meet the head surface 8 of the vessel. The conical form of this zone provides room for the handling means. The bung, shown in dotted lines, is located in a recess of the head surface 8 of the vessel.

The separately prefabricated carrying and transport ring 1 locks geometrically into a groove-like recess 4 by means of a retaining ridge 2 at the bottom of the annular web 3 of the ring. A horizontal supporting rib 7 molded underneath the outward projection 9 rests against the wall portion conically inclined to the centerline of the vessel as it meets the head 8.

The outward projection 9, having a horizontal contact surface 10 and a vertical contact surface 11 for handling prongs of a lift truck or other lifting equipment, is attached by means of a connecting web 12 adjoining the horizontal contact surface 10 and meeting the annular web 3 of the ring at an acute angle. The top surface of the supporting rib 7 is located in the same plane as the horizontal contact surface 10.

The acute angle position of the connecting web 12 relative to the centerline of the vessel and consequently its oblique transition to the annular web 3 relieves the connecting web 12 of all but those harmless tensile loads which are generated when the vessel is carried and transported by the lift truck.

The connecting web 12 may be comparatively thin-walled, with the special advantage of high elasticity. This elasticity and the oblique angle of the connecting web 12 relative to the annular web 3 is further supported by the circumstance that the surface of the supporting rib 7 is flush with the horizontal contact surface 10. The supporting rib 7 arrests any leverage on the annular web 3.

What is claimed:

1. In a bunged vessel of thermoplastic material having a generally cylindrical wall with a vertical center line, head surfaces at each end and at least one carrying and transport ring snapped into an attachment point on the wall of the vessel near its associated head surface, with an outward projection having horizontal and vertical contact surfaces molded into its upper end suitable for prongs of a handling means, the improvement wherein:

(a) the carrying and transport ring is located with the upper end thereof disposed below the associated head surface;

(b) the wall of the vessel extending from the attachment point of the carrying and transport ring to the associated head surface is inwardly conically inclined;

(c) the wall of the vessel includes at least one groove-like recess providing a snap-on means of attachment for the carrying and transport ring; and (d) said carrying and transport ring includes:

(1) an annular web extending below the outward projection and having top and bottom ends, (2) a retaining ridge formed at the bottom end of the annular web and positioned in the groove-like recess of the vessel for locking into the carrying and transport ring into said groove-like recess, and (3) a horizontal supporting rib having upper and lower surfaces formed beneath the outward projection and making contact with the conically inclined wall portion.

2. The bunged vessel of claim 1, the improvement wherein the carrying and transport ring further comprises:

(a) a connecting web connecting the outward projection to the top end of the annular web, said connecting web adjoining the horizontal contact surface and entering the annular web at an angle inclined slightly away from the vertical center line.

3. The carrying and transport ring of claim 2 wherein:

(a) the upper surface of the horizontal supporting rib is planar with the horizontal contact surface; and (b) the connecting web has an outer annular surface which at its upper limit connects with the horizontal contact surface of the outward projection and at its lower limit to the top of the annular web at a location which is planar with the lower surface of the horizontal rib.

4. In a bunged vessel of thermoplastic material having a generally cylindrical wall with a vertical center line, head surfaces at each end and at least one carrying and transport ring snapped into an attachment point on the wall of the vessel near its associated head surface, with an outward projection having horizontal and vertical contact surfaces molded into its upper end suitable for prongs of a handling means, the improvement wherein:

(a) the vessel includes a groove-like recess in the vessel wall having an upper wall inclined away from the associated head surface providing a snap-on means of attachment for the carrying and transport ring;

(b) the wall of the vessel extending from the groove-like recess to the associated head surface is conically inclined towards the vertical center line;

(c) the carrying and transport ring is located with the upper end thereof disposed below the associated head surface;

(d) the carrying and transport ring includes:

(1) an annular web extending below the outward projection and in spaced relation to the vessel wall, said web having top and bottom ends, (2) a retaining ridge extending radially inwardly from the bottom end of the annular web and into said groove-like recess, said ridge having a shape complementary to the groove-like recess;

(3) a horizontal supporting rib having upper and lower surfaces and extending radially inwardly from the top end of the annular web and into engagement with the conically inclined wall of the vessel; and (4) a connecting web connecting the outward projection to the top end of the annular web, said connecting web adjoining the horizontal contact surface and entering the annular web at an angle inclined slightly away from the vertical center line.

5. The carrying and transport ring of claim 4 wherein:

(a) the upper surface of the horizontal supporting rib is planar with the horizontal contact surface; and (b) the connecting web has an outer annular surface which at its upper limit connects with the horizontal contact surface of the outward projection and at its lower limit to the top of the annular web at a location which is planar with the lower surface of the horizontal rib.

* * * * *